US009809422B2

(12) United States Patent
Mayer

(10) Patent No.: US 9,809,422 B2
(45) Date of Patent: Nov. 7, 2017

(54) CRANE

(71) Applicant: Liebherr-Werk Biberach GmbH, Biberach an der Riss (DE)

(72) Inventor: Joachim Mayer, Biberach (DE)

(73) Assignee: Liebherr-Werk Biberach GmbH, Biberach an der Riss (DE)

( * ) Notice: Subject to any disclaimer, the term of this patent is extended or adjusted under 35 U.S.C. 154(b) by 0 days.

(21) Appl. No.: 14/060,395

(22) Filed: Oct. 22, 2013

(65) Prior Publication Data

US 2014/0110367 A1 Apr. 24, 2014

(30) Foreign Application Priority Data

Oct. 23, 2012 (DE) ..... 10 2012 020 819

(51) Int. Cl.

| | |
|---|---|
| ***B66B 9/00*** | (2006.01) |
| ***B66C 23/62*** | (2006.01) |
| ***B66C 13/54*** | (2006.01) |
| ***B66C 15/00*** | (2006.01) |

(52) U.S. Cl.

CPC ..... *B66B 9/00* (2013.01); *B66C 13/54* (2013.01); *B66C 15/00* (2013.01); *B66C 23/62* (2013.01)

(58) Field of Classification Search

CPC .. B66B 9/00; B66B 5/00; B66B 5/005; B66B 5/0056; B66B 13/00; B66B 13/02; B66B 13/24; B66B 13/245; B66C 23/62; B66C 15/00; B66C 13/52; B66C 13/54

USPC ..... 212/291; 187/900

See application file for complete search history.

(56) References Cited

U.S. PATENT DOCUMENTS

| | | | | |
|---|---|---|---|---|
| 3,080,981 | A * | 3/1963 | Gerhard Kuschel et al. | 212/290 |
| 3,627,079 | A * | 12/1971 | Nielsen et al. | 187/406 |
| 3,677,370 | A * | 7/1972 | Devine | B66B 5/025 187/280 |
| 5,554,832 | A * | 9/1996 | Lumme | B66B 1/468 187/380 |
| 2008/0217112 | A1* | 9/2008 | Puskala et al. | 187/392 |
| 2011/0084491 | A1* | 4/2011 | Kassner | F03D 11/00 290/55 |

FOREIGN PATENT DOCUMENTS

| | | | |
|---|---|---|---|
| DE | 3721673 | A1 | 1/1989 |
| DE | 9107493 | U1 | 2/1992 |
| DE | 10025074 | A1 | 11/2001 |
| EP | 1016616 | A1 | 7/2000 |
| EP | 2639193 | A1 | 9/2013 |
| FR | 2675196 | A1 | 10/1992 |
| FR | 2936236 | A1 | 3/2010 |
| NL | 1017257 | C2 | 8/2002 |

OTHER PUBLICATIONS

English translation of FR2675196.*

Screenshots from youtube video "retake of the old ASEA Traction elevator built 1939 . . . ", posted Jun. 22, 2010, https://www.youtube.com/watch?v=QVdYzF5Camo, obtained Jun. 23, 2016.*

English Translation of DE 10,025,074 A1 from espacenet.com.*

* cited by examiner

*Primary Examiner* — Sang Kim
*Assistant Examiner* — Nathaniel Adams
(74) *Attorney, Agent, or Firm* — McCoy Russell LLP

(57) ABSTRACT

A tower crane, and in particular a hammerhead crane, having at least one crane operator elevator, wherein the at least one crane operator elevator is arranged inside the rectangular cross section of the crane tower.

19 Claims, 3 Drawing Sheets

CRANE

The invention relates to a tower crane, and in particular to a hammerhead crane, having at least one crane cab and at least one crane operator elevator.

Hammerhead cranes with stationary towers have until now been equipped with crane operator elevators in special situations, in order to make the ascent to the crane cab more comfortable, especially for very tall towers. Until now only a few countries had issued legal requirements for the installation of a crane operator elevator. This situation will surely change in the near future, so that the installation of an elevator will be legally required for an ascent height of 60 meters.

Previous solutions suggest that commercially available elevators will be installed outside the rectangular cross section of the crane tower, which can be held in position by rails or cable guides and caused to move vertically with the aid of rack and pinion drives or cable winches.

The object of the present invention is to improve upon a tower crane of the type described previously so that it is simplified with respect to erection and is optimized with respect to space requirements.

This objective is achieved by a hammerhead crane according to the features of claim 1. Additional advantageous embodiments of the hammerhead crane are the subject of the dependent subclaims.

Accordingly, a tower crane, and especially a hammerhead crane, is proposed that has at least one crane cab as well as at least one crane operator elevator. In contrast to the teachings of the prior art, the invention provides that the at least one crane operator elevator is arranged inside the rectangular cross section of the crane tower.

An arrangement of the crane operator elevator inside the rectangular cross section of the crane tower implies that at least a large number of the elevator components are fixed to the individual crane components inside the rectangular cross section of the crane tower, and to the tower sections in particular. In particular, the elevator car will travel in the vertical direction inside the rectangular cross section of the crane tower.

The original rectangular cross section of the crane tower can be retained by means of the arrangement of the crane operator elevator according to the invention. This is not advantageous only during operation at the construction site, but also has certain advantages during transport, as well as during the rigging of the crane.

The crane cab itself can be designed to be open or closed. The lower entry to the crane operator elevator is advantageously provided in the region of the lowermost tower sections. The upper entry, on the other hand, is arranged in the region of the at least one crane cab. The crane operator elevator allows the crane operator to be transported comfortably, rapidly, and especially, safely from the base of the crane up to the crane cab.

It is especially advantageous when one or more guide rails are arranged inside the rectangular cross section of the crane tower to guide the elevator car. The guide rails can be designed as a single rail or pairwise with parallel tracks. The guide rails are advantageously formed as multiple sections; it being especially advantageous to provide one rail segment per tower section.

The guide rails are ideally mounted rigidly on the crane, and remain on the crane tower during transport of the crane. The assembly of the guide system is thus accomplished once as the crane is being built, or when retrofitting existing cranes with the elevator system according to the invention.

However, a complete disassembly of the elevator system can also be carried out in principle for transporting the crane. In this case all elevator components are detachably connected to the crane.

Misalignments can occur at the transition between neighboring guide rail segments due to engineering tolerances of the crane tower design as well as variances during installation of the guide rails. A vertical offset between neighboring rail segments plays a role, in addition to the horizontal offset. Against this background, it is advantageous when the connection between the crane side guide rails and the elevator car guide means allows for a certain amount of play. This makes it possible to simply reconcile individual variances or unevenness between the guide rails during operation of the elevator. The crane cab can thereby overcome such variances or unevenness without difficulty.

It is especially advantageous when the elevator drive is a cable drive. The cable drive is tolerant, especially with respect to variances within the guide rails.

Alternatively, the drive for the crane operator elevator can be a rack and pinion drive. Rack and pinion drives, however, require precise assembly of the guide rails. Any offset in the rail system must be corrected, thus requiring extensive effort by readjusting the connection to the crane tower assembly.

According to an advantageous embodiment of the tower crane according to the invention, the tower crane has one or a plurality of receptacles on the individual tower elements that lie inside the rectangular cross section of the crane tower and enable a detachable connection of the crane operator elevator. For example, the receptacles can be designed as claws or similar clamping elements. The receptacle means, in particular claws, can be mounted to the individual crane elements, in particular, tower sections, and thereby permit a simple and uncomplicated retrofitting of existing cranes with a crane operator elevator.

It is also possible to provide special receptacles for the assembly of the elevator system, in particular for the guide rails, during the manufacture of individual crane components, in particular the tower sections. It is expedient to connect these receptacles rigidly to the crane components, in particular by welding. This especially assures the retrofitability with an elevator system at a later time.

In addition to the elevator system, at least one crane ladder can be provided by which the crane operator can reach the crane cab in the conventional manner. The crane ladder passes through the inside of the rectangular cross section of the crane tower in the conventional manner, and enables the operator to climb to the crane cab on individual ladder elements.

However, the risk that the moving elevator car might fail during the ascent of the tower must be taken into consideration. Due to the restricted space inside the rectangular cross section of the crane tower, the spacing between the elevator system and crane ladder must be specified to be large enough. If spatial relationships do not provide an adequate safety margin, appropriate safety measures must be taken to exclude the possibility of injury to a person on the crane ladder by the moving elevator car.

One possible safety measure is to place one or a plurality of mechanical shields in the crane ladder region to block access to the crane elevator system, and at best to prevent it. For example, individual gratings are available that can be arranged in the region of the intermediate landings of each tower section. However, the protective elements present an additional wind impact surface, which can have a further negative effect on the calculated structural integrity of the crane. In the worst case, the maximum structure height of the crane must be reduced or the effort needed to assure structural integrity increases significantly. The required amount of ballast or the engineering design of the crane foundation will be affected.

A meaningful alternative can be to install an access control system in order to be able to control at least the access to a crane ladder.

Up to now, unauthorized persons could climb at least up to the crane cab, since admission to the tower was neither locked nor otherwise secured. The integration of the access control system permits monitoring of the crane operator elevator and/or the crane ladder starting at the lowest entry point. For example, an authorized person can be denied access to the crane system, and to the crane cab in particular. In addition, the control system, or the crane controller that is connected to the control system, identifies the number of persons currently occupying the crane operator elevator or on the crane ladder. It can thereby be assured that authorized persons also leave the crane ladder or crane elevator promptly and do not remain in it too long. Such an access control system can, for example, be used to sense motion by means of which the access control system and/or the monitoring of the safety zones or regions of motion of the elevator can be monitored.

It can furthermore be advantageous when only a single authorized person is granted access to the crane ladder or to the crane operator elevator, which must first of all be authenticated by means of an access key. A mechanical and/or electronic access key can be used. Electronic keys having any kind of chips or cards that store electronic data that are readable by the access control system can be used. The access control system can either allow or block access depending on its evaluation of the data.

Access to the crane ladder or to the crane elevator can be controlled by one or a plurality of access doors. These doors will be automatically unlocked or opened as long as the access control system approves access of an authorized person to the crane ladder. It is appropriate to provide at least one door at the lowest entry region. Ideally, at least one additional door is provided at the upper entry point.

It is especially advantageous when a controller is provided that controls the operation of the crane operator elevator as a function of the access control system of the at least one crane ladder. Acknowledging the presence of individuals currently in the crane ladder, an appropriate control of the crane elevator can be exercised whereby the danger to these persons due to elevator motion can be minimized to the greatest possible extent or completely eliminated.

It is especially advantageous when the power supply to the crane operator elevator is deactivated as soon as access is granted to the crane ladder. In principle, the deactivation of the crane elevator can be delayed as long as the elevator car is located between the lower and upper stopping points. This allows the cabin to continue traveling to a well defined stopping point. It is even more appropriate to only grant access to the crane ladder if the elevator cabin is located at a stopping point and is not in operation. Interruption of the power supply can be carried out immediately after access is granted.

Reactivation of the power supply is advantageously carried out by the controller as soon as access is blocked to the crane ladder. Blocking of access to the crane is possible as soon as it can be assured that nobody remains in the region of the crane ladder. Ideally, access control is accomplished when a person enters the crane ladder, wherein egress from the ladder is also monitored. This requires that the controller have knowledge of whether persons located in the crane ladder region have again moved out of it.

To the extent that electronic keys can be used, the access control system can be equipped with one or more reader units that are suited for wireless reception of electronic key data. In this case the entrance of an electronic key into the receiver region of one of the reader units can be sufficient to unblock access to the crane ladder.

The reader unit or the electronic key can be implemented as an RFID system that is activated when the electronic key approaches one of the reader units, causing data transfer to the reader unit. An LWID system (according to the IEEE Standard), which is also known as RuBee technology, can also be specified instead of using RFID technology.

It is especially advantageous when the reader units are distributed over the ladder path, so that the distance covered by the person or the electronic key can be traced. This simplifies the task of checking whether the respective person or electronic key has entered or exited the crane ladder region. Ideally, this can even permit the specific localization of the authorized persons. The precise position information can then be evaluated by the controller for controlling the elevator. In this case it would be sufficient to limit the distance of travel of the elevator. Insofar as the distance of travel of the elevator does not coincide with the exact position of the authorized person, the elevator operation can be maintained.

For safety reasons, however, it is preferred that the power supply of the crane elevator be deactivated as soon as at least one electronic key is detected inside the crane elevator region by a reader unit.

The access control system is ideally designed so that access to the elevator system or alternatively to the crane ladder is selectively assured.

Additional advantages and features of the invention will be explained with the aid of the embodiments shown in greater detail in the drawings. The drawings show:

Figure 1A:
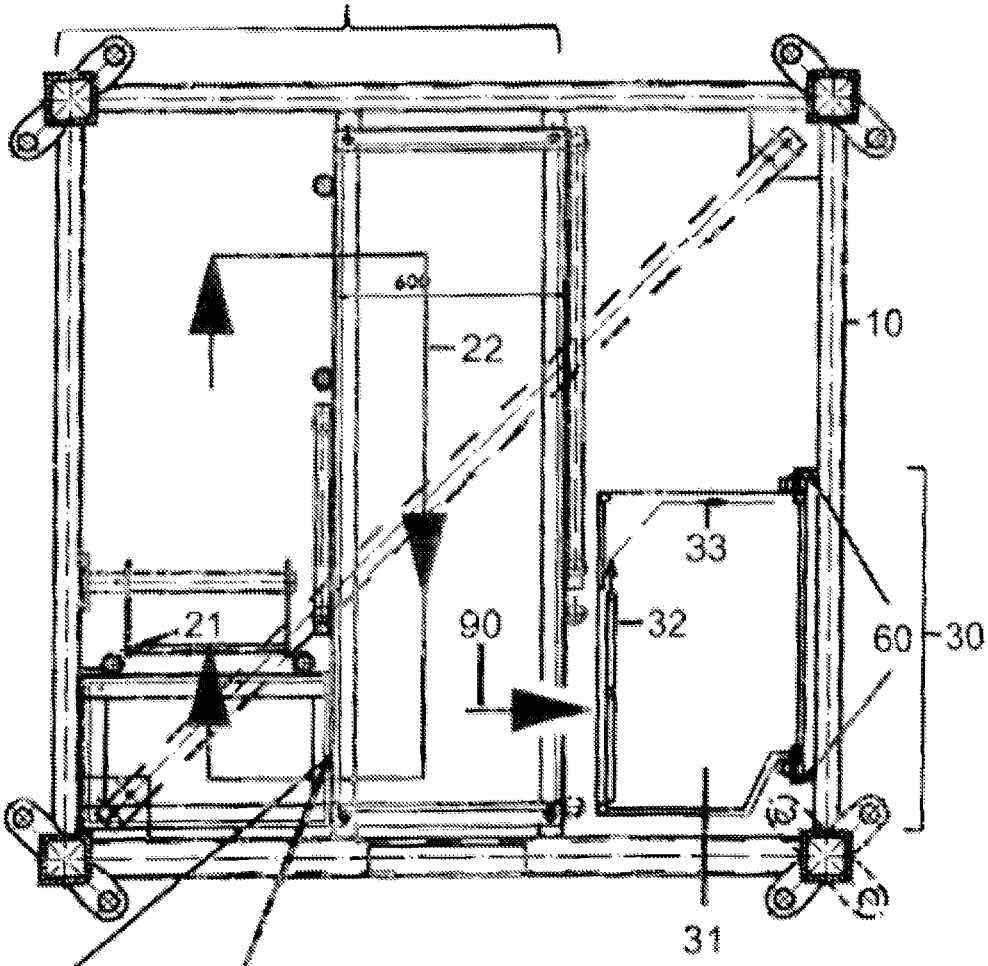
FIG. 1A shows a cross section view through the tower of the tower crane according to the invention.
Figure 1B:
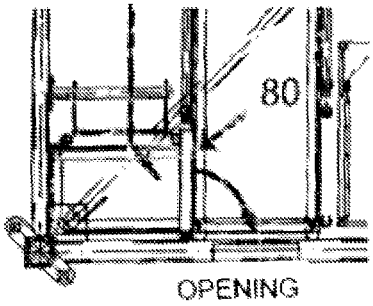
FIG. 1B shows a detailed view of the lower entry point to the crane ladder, and FIG. 1C schematically shows an access control system and crane controller.
Figure 1C:
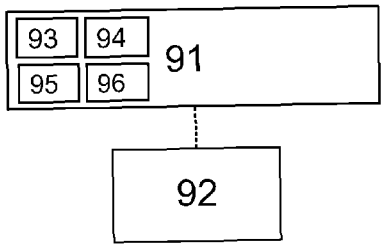

FIG. 1 shows a cross section through a single tower section 10 of the hammerhead crane according to the invention. The entire hammerhead crane has a conventional tower ladder 20, which consists of individual ladder elements 21. The crane operator can thus enter into the hollow space of the lowest tower section and reach the crane cab 40 (FIG. 2) by means of the ladder arrangement 21. The space requirement for the crane ladder requires approximately two thirds of the rectangular cross section of the crane tower. The arrow 22 indicates the stairway path through tower section 10.

According to the invention, a crane operator elevator 30 is located in the remaining cross sectional area, which complements the conventional crane ladder (20). The elevator shaft is located in the plane of the drawing to the right and under the depicted corner of the tower section, and occupies approximately half of the remaining cross sectional area.

Figure 2:
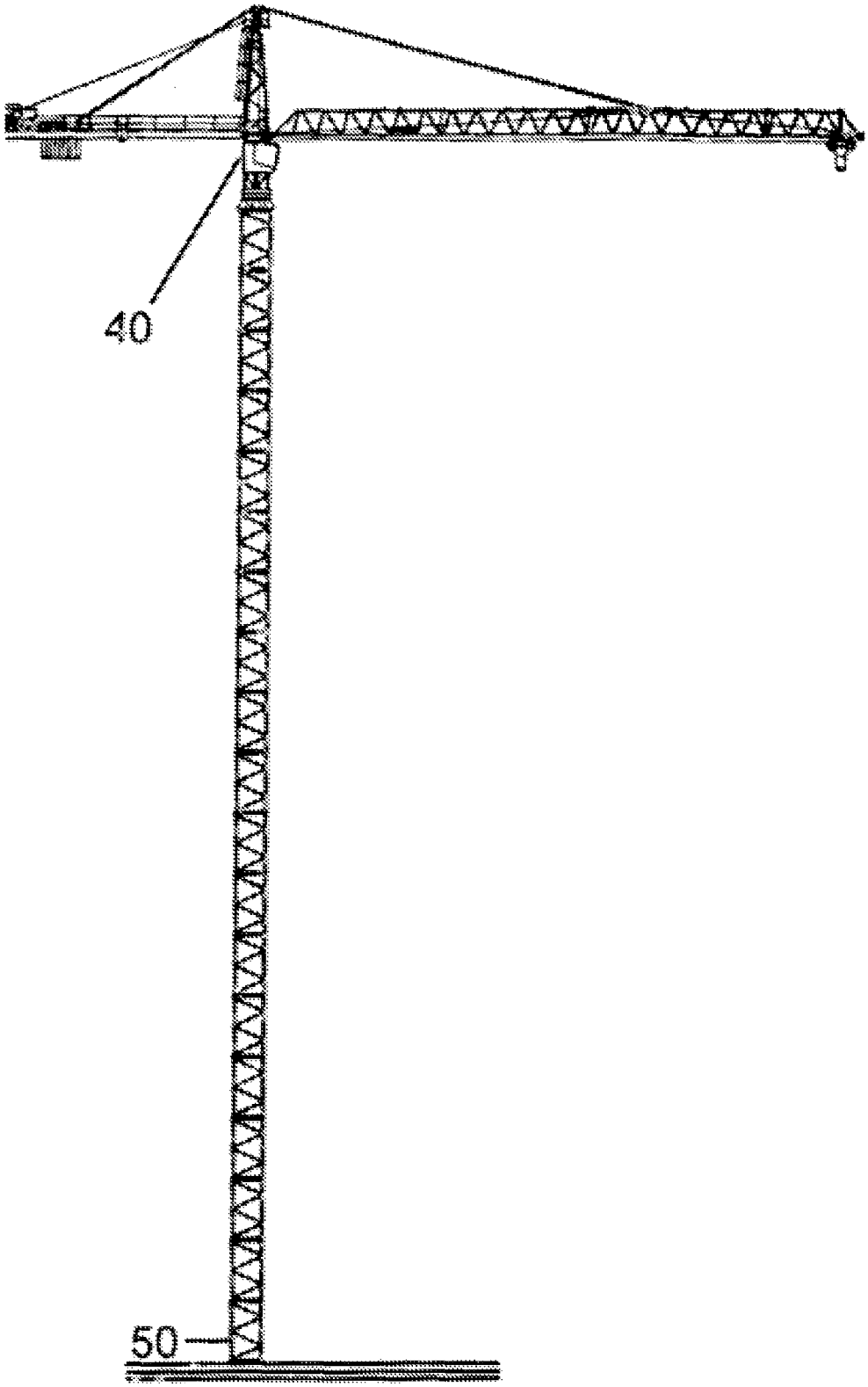
FIG. 2 shows a schematic side view of the tower crane according to the invention.
Figure 3:
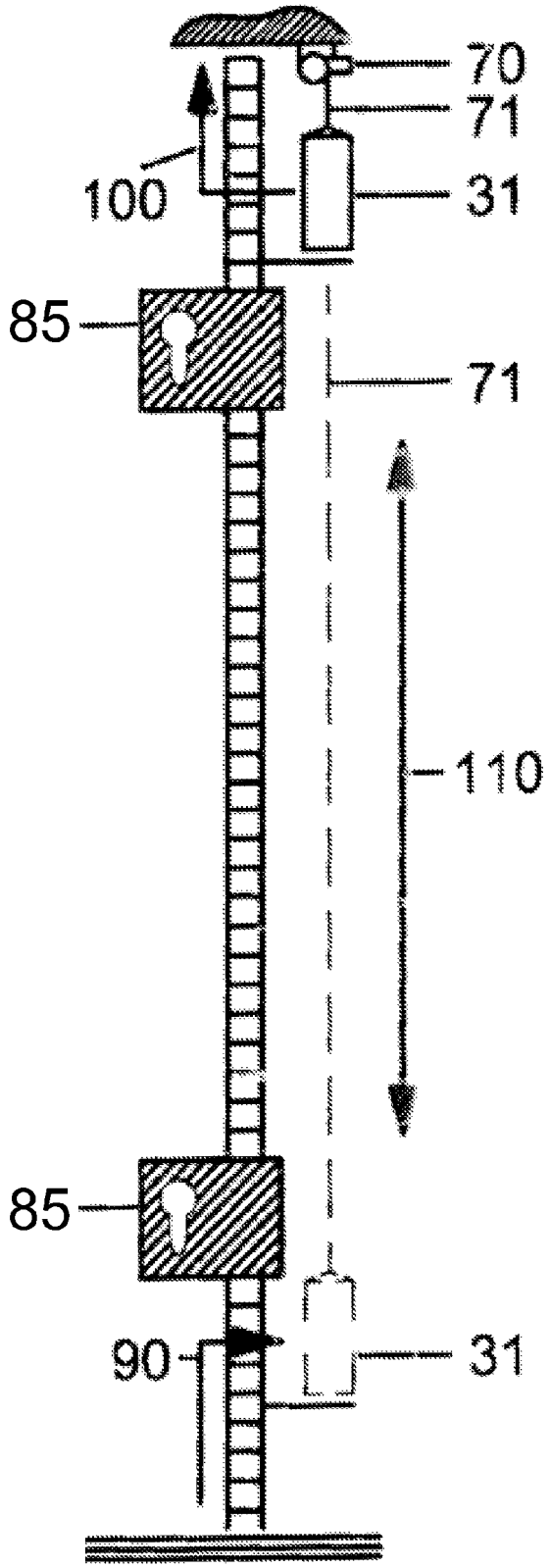
FIG. 3 shows a detailed view of the crane ladder and crane operator elevator.

The car 31 of the crane operator elevator 30 slides from the base of the tower 50 up to the crane cab 40 in the vertical direction (FIGS. 2 and 3). Two guide rails 60 are provided as guiding means, which pass inside the tower sections parallel to one another in the vertical direction from the base of the tower 50 to the crane cab 40. The car 31 itself is at least partially closed. A mechanical door mechanism 32 is used to enter the cabin. In order to open the access door 32, it is slid inwardly into the car 31 in the direction of arrow 33. Other opening mechanisms are obviously possible, and are included within the scope of the invention.

A cable drive is used to drive the crane operator elevator 30, which is designed in a well known manner and form. The capstan 70 is provided (FIG. 3) in the region of the top of the tower, such that the elevator cable 71 passes from the elevator car 31 to the top of the tower, and is wound onto or about the capstan 70. Alternatively, the capstan can be arranged on the roof of the elevator car in a manner and form not shown here.

Since the guide rails 60 remain fixed to the individual tower sections 10 during transport of the crane, it is necessary that they be subdivided into individual guide rail segments. Individual elements are thus mounted on the inside of each assembled tower section.

Due to certain fabrication tolerances of the tower sections, a misalignment between the neighboring guide elements of the guide rails 60 may occur while rigging the individual tower sections. In order to eliminate time consuming readjustments, a certain amount of play is allowed in the guide rails 60 during engagement of the guide means of the car 31. In combination with the cable drive, it is possible to pass over such misalignments between neighboring guide elements without difficulty.

An access control system 91 is installed for safety reasons in order to avoid the hazard to personnel in the crane ladder 20 region caused by the elevator car 31. A crane controller 92 is connected to the control system. The access control system has one or a plurality of reader units 93 for wireless reception of electronic key data, including data based on an RFID system 94, an LWID system 95, or a radio transmission system 96, wherein reception is provided over an entire length of the at least one crane ladder.

As can be seen in FIG. 1*a*, access to the crane ladder 20 can be opened or blocked by a door assembly 80. The mechanical closing motion of the door 80 can be accomplished either automatically or manually. A door control mechanism is claimed for locking and unlocking the door 80 electronically through the access control system.

The door 80 that is shown is arranged in the entrance region to the crane ladder 20 in the vicinity of the base of the crane. Another door element 80 is also located at the top of the tower, which blocks or enables access to the crane ladder.

However, it must be assured that the access 90, 100 to the crane elevator 30 is not blocked by the door 80. In the indicated exemplary embodiment, the door 80 is arranged in the vertical direction above the entrance 90 to the elevator system 30. The crane operator is allowed access to the crane ladder 20 with the aid of a mechanical and/or electronic access key 85. If the door 80 is opened, the crane control system then automatically blocks the power to the elevator system 30 so that elevator operation is prevented when the crane ladder 20 is unblocked.

After the door 80 is closed, it must then be locked with the key, after which permission to vacate is granted through a key switch. As soon as all required steps have been carried out according to specifications, the operation of the elevator 30 is again enabled. The same is true for access to the crane ladder 20 at the top, in which the upper access 100 is freely accessible to the elevator car 31, but access to the stairs descending the tower 20 is blocked and can be opened only by means of keys.

In case of emergency, a key can be located in a glass box at both doors 80.

Furthermore, access 90, 100 to the elevator 30 can likewise be secured by a key.

Alternatively or in addition, one or more RFID chip reader units can be installed in each door 80. Persons who wish to enter the secured region of the crane ladder 20, whether gaining access from the top or bottom, must have an RFID chip that displays the appropriate dates for access from the access control system. Upon entry of the person having the RFID chip in the receiver region of the reader units, the electronic key data can be read by the chips and access is granted for the doors 80. The same is true for access 90, 100 to the cabin, which can likewise be controlled by means of reader units.

In this case as well, the power to the crane operator elevator 30 can be interrupted as soon as one of the doors 80 is opened or unlocked. The actual passage through the door 80 by the person is simultaneously detected by the electronic access control system due to the movement of the chip. For this reason a plurality of reader units are distributed over the entire crane tower in order to enable continuous reception over the length of the tower. This authorized region is designated by the arrow 110. The path of motion of the chip, or the person, can thereby be determined and evaluated in the crane control system. Only after the person having the RFID chip leaves the secured region 110 can the door 80 at the bottom or at the top again be locked and the power restored to the crane operator elevator 30.

The invention claimed is:

1. A tower crane comprising a crane tower, at least one crane cab, at least one crane operator elevator, and at least one crane ladder, wherein the at least one crane operator elevator comprises an elevator car configured to travel in a vertical direction inside a rectangular cross section of the crane tower, wherein access to the at least one crane ladder and the at least one crane operator elevator is secured by an access control system comprising a controller that controls the operation of the at least one crane operator elevator, wherein the at least one crane ladder is secured by one or more access doors including an access door at a lower entrance to the at least one crane ladder, wherein the controller deactivates a power supply of the at least one crane operator elevator as soon as access to the at least one crane ladder via the one or more access doors is enabled, wherein the controller activates the power supply as soon as access to the at least one crane ladder via the one or more access doors is blocked, and wherein access to the at least one crane operator elevator is not blocked by the one or more access doors when the one or more access doors are closed.

2. The tower crane according to claim 1, wherein one or more guide rails for guiding the at least one crane operator elevator is arranged inside the rectangular cross section of the crane tower in a vertical direction from a base of the crane tower to the at least one crane cab, wherein the tower crane comprises a stationary tower.

3. The tower crane according to claim 2, wherein an elevator car guide on a side of the at least one crane operator elevator and the one or more guide rails engage with one another to compensate for play due to variances and unevenness of the one or more guide rails.

4. The tower crane according to claim 1, wherein access to the one or more access doors is enabled or blocked via a mechanical and/or electronic key.

5. The tower crane according to claim 1, wherein the access control system has one or a plurality of reader units for wireless reception of electronic key data, including data based on an RFID system, an LWID system, or a radio transmission system, wherein reception is provided over an entire length of the at least one crane ladder.

6. The tower crane according to claim 5, wherein the access control system assures selective access to the at least one crane operator elevator or to the at least one crane ladder.

7. The tower crane of claim 1, wherein the one or more access doors include an access door at an upper entrance to the at least one crane ladder.

8. The tower crane of claim 1, wherein the one or more access doors are automatically unlocked or opened as long as the access control system approves access of an authorized person to the at least one crane ladder.

9. The tower crane of claim 5, wherein the access control system comprises a plurality of reader units.

10. The tower crane of claim 9, wherein distribution of the reader units on the crane tower enables continuous reception of the electronic key data over a length of the crane tower, and wherein a path of motion of a person can thereby be determined and evaluated in the access control system.

11. The tower crane of claim 10, wherein only after the person leaves a secured region can power be restored to the at least one crane operator elevator.

12. The tower crane of claim 1, wherein a lower entry to the at least one crane operator elevator is arranged at a lowermost tower section of the tower crane, and wherein an upper entry to the at least one crane operator elevator is arranged at the at least one crane cab.

13. The tower crane of claim 1, wherein the access door at the lower entrance to the at least one crane ladder is arranged in a vertical direction above a lower entry to the at least one crane operator elevator.

14. The tower crane of claim 1, wherein the access door at the lower entrance to the at least one crane ladder is arranged at a lowest entry region to the at least one crane ladder in a vicinity of a base of the crane tower.

15. The tower crane of claim 7, wherein the upper entrance to the at least one crane ladder is at a top of the crane tower.

16. The tower crane of claim 1, further comprising, in addition to the one or more access doors which secure the at least one crane ladder, an access door for entering the elevator car.

17. The tower crane of claim 16, wherein the access door for entering the elevator car is a side door and is configured to slide inwardly into the elevator car.

18. The tower crane of claim 1, wherein the space requirement for the at least one crane ladder requires approximately two thirds of the rectangular cross section of the crane tower, and wherein the at least one crane operator elevator is located in the remaining rectangular cross section of the crane tower.

19. The tower crane of claim 18, wherein a shaft of the at least one crane operator elevator occupies approximately half of the remaining rectangular cross section of the crane tower.

* * * * *